US007891616B2

(12) United States Patent
Pinchuk et al.

(10) Patent No.: US 7,891,616 B2
(45) Date of Patent: Feb. 22, 2011

(54) ASSEMBLY FOR SECURING AN ARTICLE ON A MOUNTING SURFACE

(75) Inventors: Bryan Pinchuk, Miami, FL (US); Leonard Pinchuk, Miami, FL (US)

(73) Assignee: Room-D Products LLC, Miami, FL (US)

( * ) Notice: Subject to any disclaimer, the term of this patent is extended or adjusted under 35 U.S.C. 154(b) by 0 days.

(21) Appl. No.: 12/435,558

(22) Filed: May 5, 2009

(65) Prior Publication Data

US 2009/0272862 A1 Nov. 5, 2009

Related U.S. Application Data

(60) Provisional application No. 61/050,298, filed on May 5, 2008.

(51) Int. Cl.
*A47G 1/17* (2006.01)

(52) U.S. Cl. ..... 248/206.5; 248/493; 248/497

(58) Field of Classification Search ..... 248/206.5, 248/547, 683, 475.1, 489, 490, 493, 497, 248/498

See application file for complete search history.

(56) References Cited

U.S. PATENT DOCUMENTS

2005/0156085 A1* 7/2005 Radovan ..... 248/110
2006/0196069 A1* 9/2006 Groepper ..... 33/613
2009/0140120 A1* 6/2009 Nicolaisen ..... 248/467

* cited by examiner

*Primary Examiner*—Ramon O Ramirez
(74) *Attorney, Agent, or Firm*—Gordon & Jacobson, PC

(57) ABSTRACT

An assembly for securing an article with a support member affixed or integral thereto to a mounting surface. The assembly includes first and second members having means for detachably coupling together the first and second members through magnetic field interaction therebetween. The ffirst member includes means for detachably coupling to the support member of the article. The second member includes means for securing to the mounting surface, and a hook portion that receives the support member of the article. During use, the first member is coupled to the support member of the article, and the second member is secured to the mounting surface at a desired position. The first and second members are guided and coupled together by magnetic field interaction therebetween. The support member is then decoupled from the first member and moved such that it engages and is supported by the hook portion of the second member.

33 Claims, 4 Drawing Sheets

ASSEMBLY FOR SECURING AN ARTICLE ON A MOUNTING SURFACE

CROSS-REFERENCE TO RELATED APPLICATIONS

This application claims benefits from U.S. Provisional Patent Application No. 61/050,298, filed May 5, 2008, the contents of which are hereby incorporated herein by reference.

BACKGROUND OF THE INVENTION

1. Field of the Invention

This invention relates to mechanisms for hanging articles on a wall or other vertical support surfaces.

2. State of the Art

Pictures, paintings, or other articles (referred to herein as "wall hangings") in general are often mounted on walls via fasteners located on the wall hanging as well as at least one fastener located on the wall. A popular mechanism for hanging paintings and the like on a wall employs eyelets that are secured by screws to the opposed vertically extending side sections of the frame of a painting and to fasten a wire across the back of the painting, secured on either end by the eyelets. A hook is secured into the wall and the wire is placed into the hook to hang the painting.

Another popular mechanism of mounting a wall hanging employs metallic triangular fasteners that are secured by screws on portions of the wall hanging (e.g., opposed vertically extending sides of the frame of a picture), where the fastener fits on a hook mounted on the wall.

In both of these mechanisms, finding the hook on the wall is oftentimes difficult. In the case of the wire, large wall hangings would have long wires and often these wires are irregular in shape, that is, they have residual coil configurations, or there are dents in the wire from previous hangings, etc. Hanging the wire on the hook often requires placing an arm behind the painting and guiding the wire to the hook. This is cumbersome for both small and large wall hangings.

Similarly, the triangles fasteners often lie with the vertex aimed downward. The triangle needs to be picked up so it can fall into the hook. This is also cumbersome.

SUMMARY OF THE INVENTION

The present invention is directed to an assembly for securing an article with a support member affixed or integral thereto to a mounting surface. The assembly includes first and second members having means for detachably coupling together the first and second members through magnetic field interaction therebetween. The first member includes means for detachably coupling to the support member of the article. The second member includes means for securing to the mounting surface, and a hook portion that receives the support member of the article. During use, the first member is coupled to the support member of the article, and the second member is secured to the mounting surface at a desired position. The first and second members are guided and coupled together by magnetic field interaction therebetween. The support member is then decoupled (or partially decoupled) from the first member and moved such that it engages and is supported by the hook portion of the second member.

It will be appreciated that the assembly of the present invention provides for magnetically guided coupling of the support member of the article to the hook portion of the assembly in a manner that is effective and easy to use. Importantly, it alleviates the difficulties in positioning of the support member in the prior art mechanisms as discussed above.

In an illustrative embodiment, the means for securing the second member to the mounting surface is realized by a mounting hole and possibly a slot extending from the mounting hole, wherein the mounting hole and optional slot receive a nail for nailing the second member to the mounting surface in order to secure the second member to the mounting surface.

In one embodiment where the support member is realized by a ferromagnetic material, the means for detachably coupling to the support member of the article can be a magnet for magnetically coupling to the ferromagnetic material of the support member. Alternatively, the means for detachably coupling to the support member of the article can be a hook or clip or other suitable mechanical fastening mechanism for detachably engaging the support member of the article.

In the preferred embodiment, the means for detachably coupling together the first and second members is realized by a permanent magnet affixed or integral to the first or second member, and most preferably by a first permanent magnet affixed or integral to the first member and a second permanent magnet affixed or integral to the second member.

In the preferred embodiment, the first and second members are magnetically coupled together in a coupled configuration with the first member disposed above the hook portion of the second member. From this configuration, the support member of the article can be moved downward such that it engages the hook portion of the second member.

In the illustrative embodiments, the support member of the article can be realized by a wire, rope, filament or triangular hanger element that is received by the hook portion of the second member.

In another aspect of the invention, an apparatus is provided for securing an article to a mounting surface whereby the article has a ferromagnetic support member affixed or integral thereto. The apparatus includes a member having means for securing to the mounting surface, a hook portion that receives the support member of the article, and a magnet that is disposed above the hook portion. The magnet provides guided coupling to the ferromagnetic support member of the article through magnetic field interaction therebetween. During use, the member is secured to the mounting surface at a desired position. The ferromagnetic support member of the article is guided and coupled to the magnet of the member by magnetic field interaction therebetween. The support member is then decoupled (or partially decoupled) from the magnet and moved downward such that it engages and is supported by the hook portion of the member.

It will be appreciated that the apparatus of the present invention provides for magnetically guided coupling of the support member of the article to the hook portion of the apparatus in a manner that is effective and easy to use. Importantly, it alleviates the difficulties in positioning of the support member in the prior art mechanisms as discussed above.

In an illustrative embodiment, the means for securing the member to the mounting surface is realized by a mounting hole and possibly an optional slot extending from the mounting hole, wherein the mounting hole and optional slot receive a nail or other fastening means for securing the member to the mounting surface.

In the illustrative embodiments, the support member of the article can be realized by a wire, rope, filament or triangular hanger element that is received by the hook portion of the second member.

Additional objects and advantages of the invention will become apparent to those skilled in the art upon reference to the detailed description taken in conjunction with the provided figures.

BRIEF DESCRIPTION OF THE DRAWINGS

FIG. 5 is a perspective view of the coupling member of FIG. 4 in use, being coupled to a wire support for a wall hanging or the like.

FIG. 7 is a perspective view of the coupling member of FIG. 6 in use, being coupled to a wire support for a wall hanging or the like.

DETAILED DESCRIPTION OF THE PREFERRED EMBODIMENTS

Figure 1:
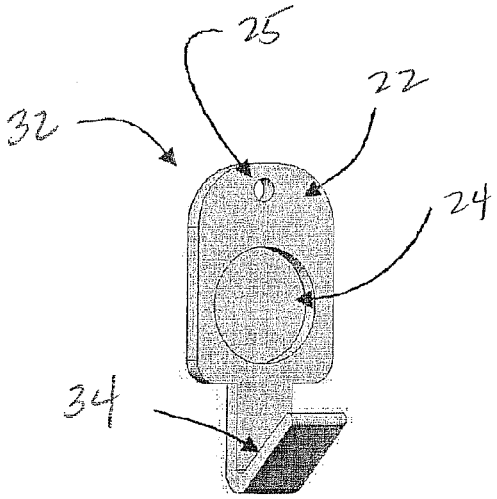
FIG. 1 is a perspective front view of the plate portion of a hook member in accordance with the present invention.
Figure 2:
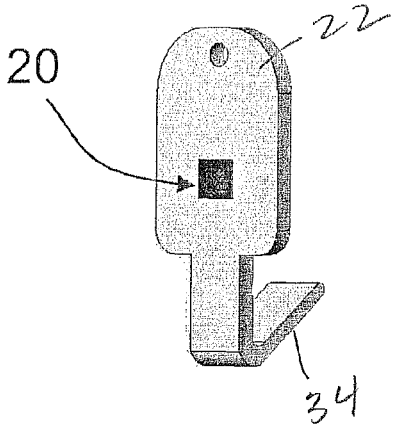
FIG. 2 is a perspective rear view of the plate portion of the hook member of FIG. 1.
Figure 3:
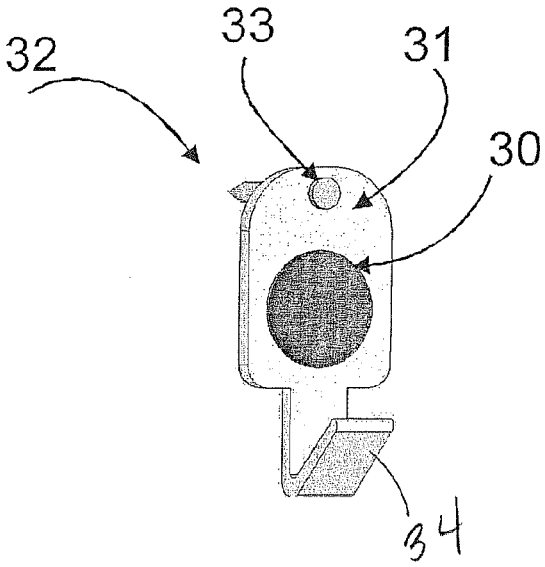
FIG. 3 is a perspective front view of a hook member in accordance with the present invention, including the plate portion of FIGS. 1 and 2 as well as a magnet affixed to the plate portion and a securing nail received by a hole in the plate portion.

Turning now to FIGS. 1-3, there is shown a hook member 32 in accordance with the present invention. The hook member 32 includes a plate 22 with a hook portion 34 extending from its bottom portion. The mid section of the plate 22 defines an indentation or recess 24 that receives a permanent magnet 30 to be affixed thereto by either a press fit or by an adhesive. The top portion of the plate 22 has a hole 25 therethrough. A nail 33 is inserted through the hole 25 (FIG. 3) and then nailed into a wall or other support structure in order to fixably secure the hook member 32 on the wall. The nail 33 can also be spot welded to the hook member 32 to allow the user to simply push the nail into the wall without the need of using a hammer. The nail 33 can also be integrally formed with the plate 22 and the hook portion 34 of the member 32. Alternatively, the nail 33 can be substituted by a screw that is screwed into the wall to fixably secure the member 32 to the wall. It is possible that the screw can be manipulated by hand using hand force to screw the hook into the wall and thus not needing a screwdriver. Although the nail 33 is shown to be perpendicular to the plate 22, it can be angled downward (e.g., 30 degrees) to provide better weight bearing properties to the member 32 during use.

FIG. 2 shows the reverse side of the member 32. An adhesive 20 can be applied to this side to allow for extra hold onto the wall to prevent swiveling and swaying of the member 32. The adhesive 20 can be of varying size and of any suitable material.

FIG. 3 shows the magnet 30 secured in the recess 24 of the plate 22 and the nail 33 inserted through the hole 25 of the plate 22.

Figure 4:
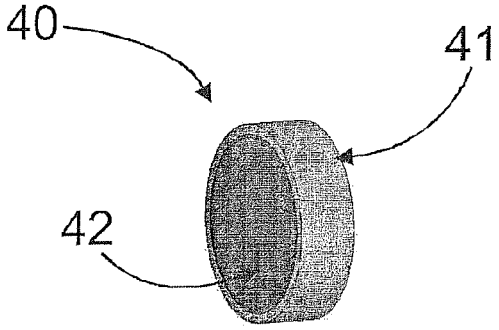
FIG. 4 is a perspective view of a coupling member in accordance with the present invention.
Figure 5:
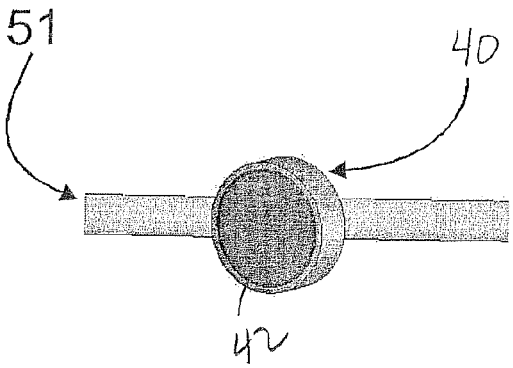

FIGS. 4 and 5 show a coupling member 40 that contains an outer plastic collar 41 and a permanent magnet 42 that fits inside the collar 41. FIG. 5 shows the coupling member 40 magnetically coupled to a ferrous wire 51. The ferrous wire 51 is secured to the wall hanging (not shown). For example, the ferrous wire 51 can extend between eyelets secured to wall hanging as is well known. The permanent magnet 42 of the coupling member 40 provides for magnetic forces that couple together the magnet 42 and the ferrous wire 51 and holds the coupling member 40 in place on the wire 51.

Figure 9:
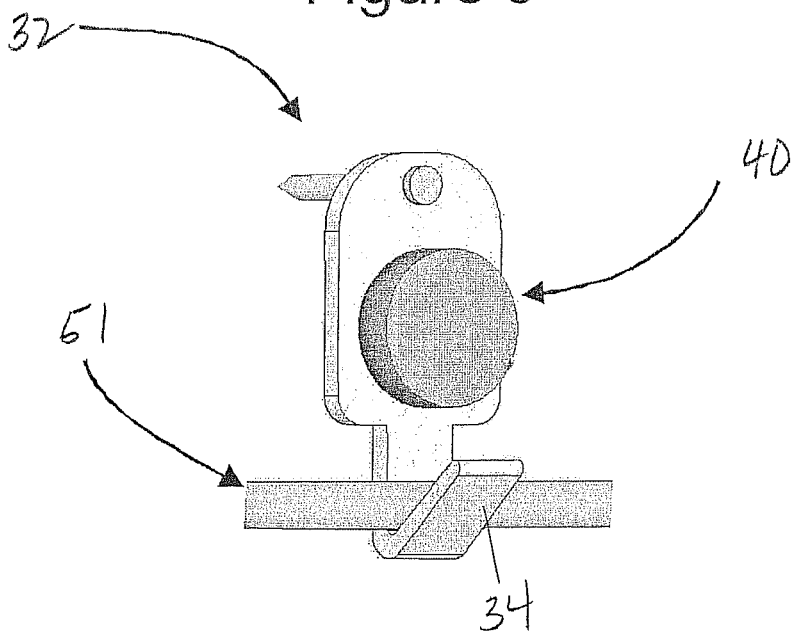

During use, the coupling member 40 is magnetically coupled to the wire 51 secured to the wall hanging. The hook member 32 (with the magnet 30 affixed thereto) is nailed or otherwise secured to the wall at a desired location. The coupling member 40 (and wire 51 magnetically coupled thereto) is moved into the magnetic force field provided by the magnet 30 of the hook member 32 in an orientation where the two magnets 30/42 are attracted to one another. This magnetic force field operates in conjunction with the magnet 42 of coupling member 40 to pull the coupling member 40 towards the magnet 30 such that the hook member 32 and coupling member 40 are positioned in a coupling configuration whereby the two magnets 30/42 are in close proximity to one another (preferably contacting with one another), and the wire 51 (which is magnetically coupled to the coupling member 40) is positioned above the hook portion 34 of the hook member 32. By movement of the wall hanging secured to the wire 51, the wire 51 is decoupled from the magnet 42 of the coupling member 40 and moved downward such that the wire 51 engages and is supported by the hook portion 34 of the hook 32 as shown in FIG. 9. In this configuration, the hook member 32 is secured to the wall and supports the wall hanging by mechanical support of the wire 51.

Advantageously, the hook member 32 and coupling member 40 employ a magnetic coupling that operates, during use, to guide the coupling member to the hook member. The user needs to only estimate where the hook member is located and the magnetic coupling will guide the coupling member (and support wire coupled thereto) to a position where it can be easily moved to engage the hook portion of the hook member. This combination allows the user to easily engage the support wire and the hook member for supporting the article. In another embodiment, the magnet 42 may be substituted by ferromagnetic metal that is magnetically attracted to the magnet 30 of the hook member 32.

Figure 6:
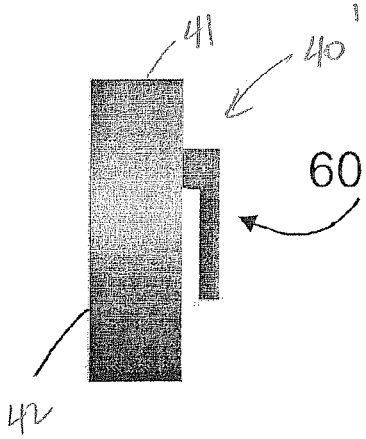
FIG. 6 is an alternate embodiment of a coupling member in accordance with the present invention.
Figure 7:
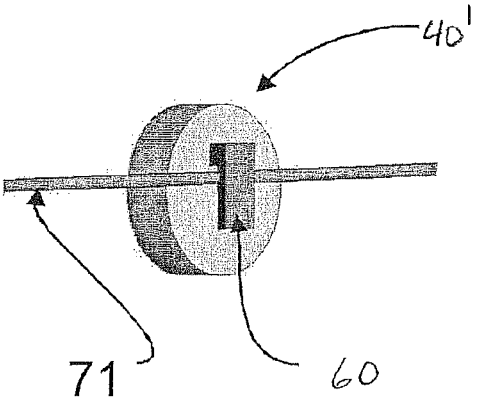
Figure 8:
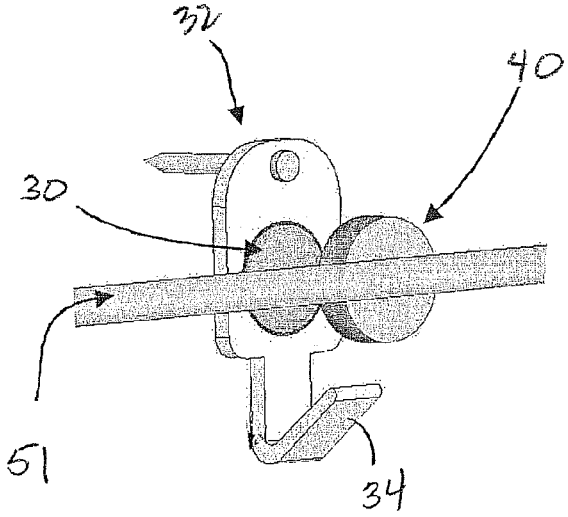
FIGS. 8 and 9 are perspective views of the hook member of FIG. 3 and the coupling member of FIG. 4 in use.
Figure 10:
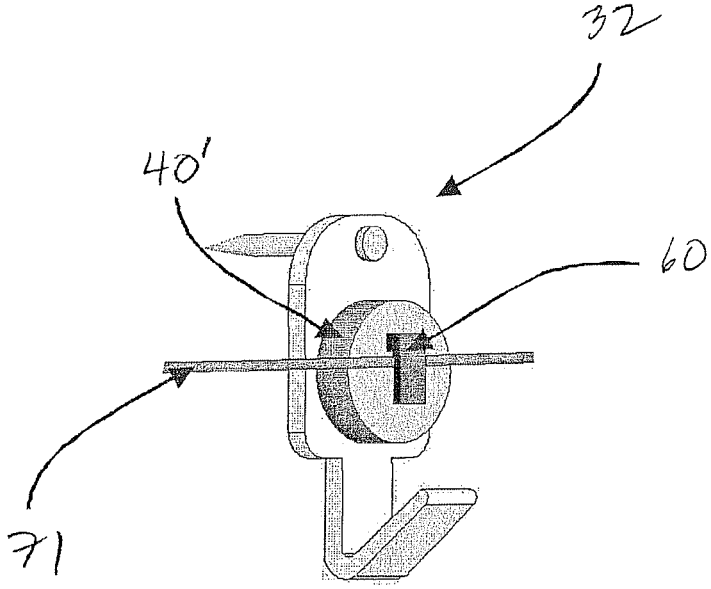
FIGS. 10 and 11 are perspective views of the hook member of FIG. 3 and the coupling member of FIG. 6 in use.

FIGS. 6 and 7 illustrate an alternate embodiment for a coupling member 40' suitable for use with wall hangings or other articles with a non-ferrous wire, rope or other filament like support 71 secured thereto. In this embodiment, the coupling member 40' has a hook or clip or other suitable mechanical fastening mechanism 60 affixed to the back side of the coupling member 40' opposite the front side that faces the hook member 32 during use (FIG. 10). The hook or clip 60 removably engages the wire or rope 71 for detachably coupling the wire or rope 71 to the coupling member 40'.

Figure 11:
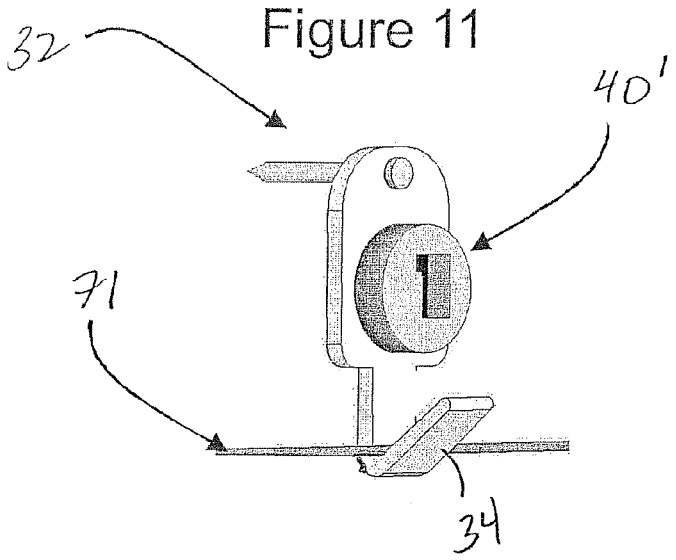

During use, the hook or clip 60 of the coupling member 40' is coupled to the wire or rope 71 secured to the wall hanging. The hook member 32 (with the magnet 30 affixed thereto) is nailed or otherwise secured to the wall at a desired location. The coupling member 40' (and the wire or rope 51 coupled thereto) is moved into the magnetic force field provided by the magnet 30 of the hook member 32. This magnetic force field operates in conjunction with the magnet 42 of coupling member 40' to pull the coupling member 40' towards the magnet 30 such that the hook member 32 and coupling member 40' are positioned in a coupling configuration whereby the two magnets 30/42 are in close proximity to one another (preferably contacting with one another), and the wire or rope 71 (which is coupled to the coupling member 40') is positioned above the hook portion 34 of the hook member 32 as shown in FIG. 10. By movement of the wall hanging secured to the wire or rope 71, the wire or rope 71 is decoupled (or partially decoupled) from the coupling member 40' and moved downward such that the wire or rope 71 engages and is supported by the hook portion 34 of the hook 32 as shown in FIG. 11. In this configuration, the hook member 32 is secured to the wall and supports the wall hanging by mechanical support of the wire or rope 71.

Figure 12:
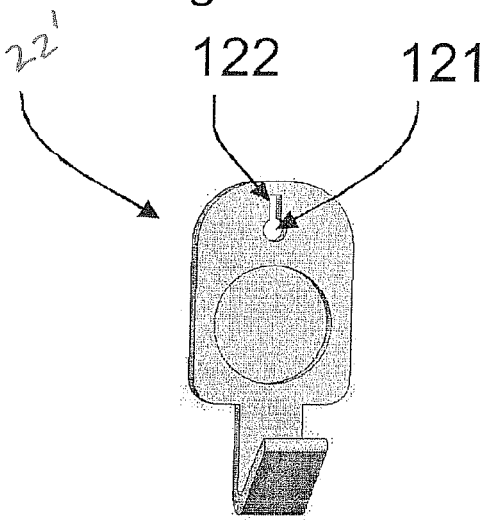
FIG. 12 is a perspective front view of a plate portion of an alternate hook member in accordance with the present invention.
Figure 13:
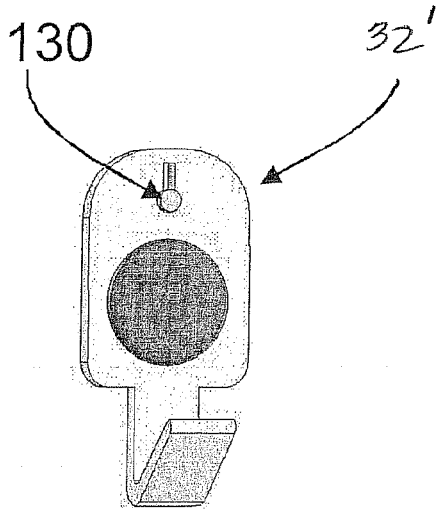
FIG. 13 is a perspective front view of an alternate hook member in accordance with the present invention, including the plate portion of FIG. 12 as well as a magnet affixed to the plate portion and a securing nail received by a hole in the plate portion.

FIGS. 12 and 13 illustrate an alternate embodiment of a hook member 32' as described herein. In this embodiment, the top portion of the plate 22' of the hook member 32' employs a hole 121 disposed below a slot 122 for supporting a nail 130. The nail 130 is first inserted into the wall. The member 32' is placed over the head of the nail through the hole 121. The member 32' is then moved downward so that the nail 130 is resting in the slot 122 with the head of the nail 130 resting against the face of the slot 122 and limiting movement of the hook member 32', thus securing the member 32' in place. In this embodiment, the nail 130 can be angled downward if necessary as described above.

In an alternate embodiment of the present invention, the hook member as described herein can be adapted to magnetically attract triangular hanger elements that are commonly used to supports pictures and the like. These triangular hanger elements are attached to the vertical portions of a frame and swivel such that they fold up and down. These triangular hanger elements are very hard to keep in position when trying to hang them. In this embodiment, the magnet of the hook member will magnetically pull a triangular hanger element into the place above the hook. When the picture is lowered, the triangular hanger elements will fall right into the hook to be engaged and supported by the hook. FIG. 3 shows an exemplary hook member suitable for use with engagement with a triangular hanger element secured to an article.

The plate, hook member and nail sections of the wall hanging hooks as described herein can be made out of aluminum, brass, stainless steel or possibly injection molded out of plastic. The optimal material will be non-magnetic so as not to interfere with the guiding function of the hook member a described herein.

It will be appreciated that the assembly and apparatus of the present invention provide for magnetically guided coupling of the support member of the article to the hook portion of the assembly that is effective and easy to use. Importantly, the assembly and apparatus of the present invention alleviate the difficulties in positioning of the support member in the prior art mechanisms as discussed above.

There have been described and illustrated herein several embodiments of apparatus and assemblies for securing an article to a mounting surface and a method of using same. While particular embodiments of the invention have been described, it is not intended that the invention be limited thereto, as it is intended that the invention be as broad in scope as the art will allow and that the specification be read likewise. Thus, while the illustrative embodiments of FIGS. 1-13 employ an assembly with two permanent magnets to provide for magnetic coupling therebetween, it will be appreciated that one of the permanent magnets can be substituted by a plate, sheet or like structure of ferrous material that provides for magnetic interaction and coupling with a permanent magnet. Furthermore, while ferrous materials are preferably used for the permanent magnet(s) of the inventions, the permanent magnet(s) of the invention can be realized by any ferromagnetic material. For the purposes of this patent application, a ferromagnetic material is a material that exhibits a magnetic moment in the absence of an external magnetic field. It will therefore be appreciated by those skilled in the art that yet other modifications could be made to the provided invention without deviating from its spirit and scope as claimed.

What is claimed is:

1. An assembly for securing an article to a mounting surface, the article having a support member affixed or integral thereto, the assembly comprising:

a first member having means for detachably coupling to the support member of the article; and a second member having means for securing to the mounting surface, and a hook portion that receives the support member of the article;

wherein the first and second members have means for detachably coupling together the first and second members through magnetic field interaction therebetween, and the means for means for securing to the mounting surface includes at least one of i) a mounting hole and ii) a nail portion that extends from the second member.

2. An assembly according to claim 1, wherein:

the mounting surface comprises a wall or other vertical surface.

3. An assembly according to claim 1, wherein:

the means for securing to the mounting surface includes the mounting hole and a slot extending from said mounting hole.

4. An assembling according to claim 1, wherein:

the means for securing to the mounting surface includes the mounting hole, and the mounting hole receives a nail for nailing the second member to the mounting surface in order to secure the second member to the mounting surface.

5. An assembly according to the claim 1, wherein:

the means for securing to the mounting surface includes the mounting hole and a nail that is received by the mounting hole and nailed to the mounting surface to secure the second member to the mounting surface.

6. An assembly according to claim 1, wherein:

the support member comprises a ferromagnetic material, and the means for detachably coupling to the support member of the article comprises a magnet for magnetically coupling to the ferromagnetic material of the support member.

7. An assembly according to claim 1, wherein:

the means for detachably coupling to the support member of the article comprises a hook or clip or other suitable mechanical fastening mechanism for detachably engaging the support member of the article.

8. An assembly according to claim 1, wherein:

the means for detachably coupling together the first and second members comprises a magnet affixed or integral to the first or second member.

9. An assembly according to claim 1, wherein:

the means for detachably coupling together the first and second members comprises a first magnet affixed or integral to the first member and a second magnet affixed or integral to the second member.

10. An assembly according to claim 1, wherein:

the first and second members are coupled together in a coupled configuration with the first member disposed above the hook portion of the second member.

11. An assembly according to claim 10, wherein:

in the coupled configuration, the first member supports the support member of the article in a position above the hook portion.

12. An assembly according to claim 1, wherein:

the support member of the article comprises a wire, rope, filament or triangular hanger element that is received by the hook portion of the second member.

13. A method for securing an article to a mounting surface, the article having a support member affixed or integral thereto, the method comprising:

providing the assembly of claim 1;

using the means for detachably coupling to the support member of the article to couple the first member to the support member of the article;

using the means for securing to the mounting surface to secure the second member to the mounting surface;

using the means for coupling together the first and second members to couple together the first and second members;

detaching the support member from the first member and moving the support member such that it is engaged and supported by the hook portion of the second member.

14. A method according to claim 13, wherein:

the mounting surface comprises a wall or other vertical surface.

15. A method according to claim 13, wherein:

the means for securing to the mounting surface includes the mounting hole.

16. A method according to claim 15, wherein:

the means for securing to the mounting surface further comprises a slot extending from the mounting hole.

17. A method according to claim 15, further comprising:

inserting a nail through the mounting hole to secure the second member to the mounting surface.

18. A method according to claim 13, wherein:

the means for securing to the mounting surface includes the nail portion extending from the second member, and the nail portion is inserted into the mounting surface in order to secure the second member to the mounting surface.

19. A method according to claim 13, wherein:

the support member comprises a ferromagnetic material, and the means for detachably coupling to the support member of the article comprises a magnet for magnetically coupling to the ferromagnetic material of the support member.

20. A method according to claim 13, wherein:

the means for detachably coupling to the support member of the article comprises a hook or clip or other suitable mechanical fastening mechanism for detachably engaging the support member of the article.

21. A method according to claim 13, wherein:

the means for detachably coupling the first and second members comprises a magnet affixed or integral to the first or second member.

22. A method according to claim 13, wherein:

the means for detachably coupling the first and second members comprises a first magnet affixed or integral to the first member and a second magnet affixed or integral to the second member.

23. A method according to claim 13, wherein:

the first and second members are coupled together in a coupled configuration with the first member disposed above the hook portion of the second member.

24. A method according to claim 23, wherein:

in the coupled configuration, the first member supports the support member of the article in a position above the hook portion.

25. A method according to claim 13, wherein:

the support member of the article comprises a wire, rope, filament or triangular hanger element that is received by the hook portion of the second member.

26. An apparatus for securing an article to a mounting surface, the article having a ferromagnetic support member affixed or integral thereto, the apparatus comprising:

a member having means for securing to the mounting surface, a hook portion that receives the support member of the article, and a magnet for guided coupling to the ferromagnetic support member of the article through magnetic field interaction therebetween, wherein the magnet is disposed above the hook portion and the means for securing to the mounting surface includes at least one of i) a mounting hole and ii) a nail portion that extends from the second member.

27. An apparatus according to claim 26, wherein:

the mounting surface comprises a wall or other vertical surface.

28. An apparatus according to claim 26, wherein:

the means for securing to the mounting surface includes the mounting hole.

29. An apparatus according to claim 26, wherein:

the means for securing to the mounting surface includes the mounting hole and a slot extending from said mounting hole.

30. An apparatus according to claim 26, wherein:

the means for securing to the mounting surface includes the mounting hole, and the mounting hole receives a nail for nailing the member to the mounting surface in order to secure the member to the mounting surface.

31. An apparatus according to claim 26, wherein:

the means for securing to the mounting surface includes the nail portion extending from the member, the nail portion for insertion into the mounting surface.

32. An apparatus according to claim 26, wherein:

in a coupled configuration, the magnet supports the support member of the article in a position above the hook portion.

33. An apparatus according to claim 26, wherein:

the support member of the article comprises a wire or triangular hanger element that is received by the hook portion of the second member.

* * * * *